United States Patent [19]

Hamisch, Jr. et al.

[11] 4,450,035

[45] May 22, 1984

[54] LABEL PRINTING AND APPLYING APPARATUS

[75] Inventors: Paul H. Hamisch, Jr., Franklin; James A. Makley, Miamisburg, both of Ohio

[73] Assignee: Monarch Marking Systems, Inc., Miamisburg, Ohio

[21] Appl. No.: 475,396

[22] Filed: Mar. 15, 1983

[51] Int. Cl.[3] ..... B65C 9/18; B65C 11/02

[52] U.S. Cl. ..... 156/384; 101/288; 156/541; 156/577; 156/579; 156/584; 156/DIG. 33; 156/DIG. 49

[58] Field of Search ..... 156/384, 541, 577, 579, 156/584, DIG. 33, DIG. 48, DIG. 49; 101/288

[56] References Cited

U.S. PATENT DOCUMENTS

| | | | |
|---|---|---|---|
| 3,837,966 | 9/1974 | Finke | 156/384 |
| 4,012,273 | 3/1977 | Inka | 156/577 |
| 4,075,052 | 2/1978 | Hamisch, Jr. | 156/541 |
| 4,267,006 | 5/1981 | Karn et al. | 101/288 |
| 4,280,863 | 7/1981 | Hamisch, Jr. et al. | 101/292 X |

*Primary Examiner*—Michael G. Wityshyn

*Attorney, Agent, or Firm*—Jacox & Meckstroth

[57] ABSTRACT

A hand-held label printing and applying apparatus includes a platen and a movable printer for successively printing pressure sensitive labels advanced across the platen by a carrier web. Each label is separated from the web by pulling the web around a delaminator with a web engaging feed wheel rotatably indexed in response to release of a finger actuator. When the apparatus is assembled for printing relatively short labels, each separated label engages applicator rollers rotatably supported by a pair of non-rotating adaptor hub members. The hub members have aligned eccentric holes for receiving a support shaft which is used without the hub members for supporting larger applicator rollers when the apparatus is assembled for printing longer labels. The carrier web is directed into engagement with the feed wheel by a form roller supported for rotation by a U-shaped adaptor which is used when the apparatus is assembled for printing shorter labels. The U-shaped adaptor is omitted when the apparatus is assembled for printing longer labels, and a larger feed wheel is assembled.

15 Claims, 5 Drawing Figures

LABEL PRINTING AND APPLYING APPARATUS

BACKGROUND OF THE INVENTION

In a hand-held label printing and applying apparatus or labeler, for example, as disclosed in U.S. Pat. Nos. 4,280,863 and No. 4,267,006 which issued to the assignee of the present invention, it is sometimes desirable for the apparatus to be used for printing and applying pressure sensitive labels of different lengths, including labels which are relatively short in the longitudinal direction of the carrier web. However, regardless of the length of the labels, it is desirable for the trailing edge of a delaminated label to remain in contact with the carrier web until the label is applied to an article, and for the leading edge of the label to project in proper relation to the applicator roller in order for the label to be properly applied to the article. If the leading edge of the label projects too far beyond the center or axis of the applicator roller, the applicator roller is not effective to press or apply the leading portion of the label onto the article. If the leading edge of the label does not project a sufficient distance past the axis of the applicator roller, the leading edge portion will not contact the article.

One means for precisely positioning the applicator roller is disclosed in U.S. Pat. No. 3,837,966 which also issued to the assignee of the present invention. In this patent, the applicator roller is supported between parallel spaced arms of a U-shaped support member which is longitudinally adjustable relative to the printing platen and the delaminator or peel roller. Thus the spacing between the applicator roller and the peel roller may be varied or adjusted according to the length of the labels being applied. When the label printing apparatus is used to print relatively short labels, it has also been found desirable to reduce the diameter of the feed wheel to provide for reducing the uniform circumferential spacing of the feed wheel teeth along with a reduction in the longitudinal spacing of the feed holes within the carrier web.

SUMMARY OF THE INVENTION

The present invention is directed to improved label printing and applying apparatus which is adapted to be assembled according to the length of the labels to be printed and applied and which incorporates adaptors when the apparatus is assembled to print and apply relatively short labels. The apparatus of the invention provides for using larger diameter applicator rollers with relatively long labels and smaller diameter applicator rollers with shorter labels. In addition, the improved label printing and applying apparatus of the invention provides an adaptor which may be used with relatively shorter labels to provide for reducing the diameter of the indexing feed wheel to accommodate closer spacing of the holes within the carrier web.

Other features and advantages of the invention will be apparent from the following description, the accompanying drawings and the appended claims.

DESCRIPTION OF THE PREFERRED EMBODIMENT

Figure 1:
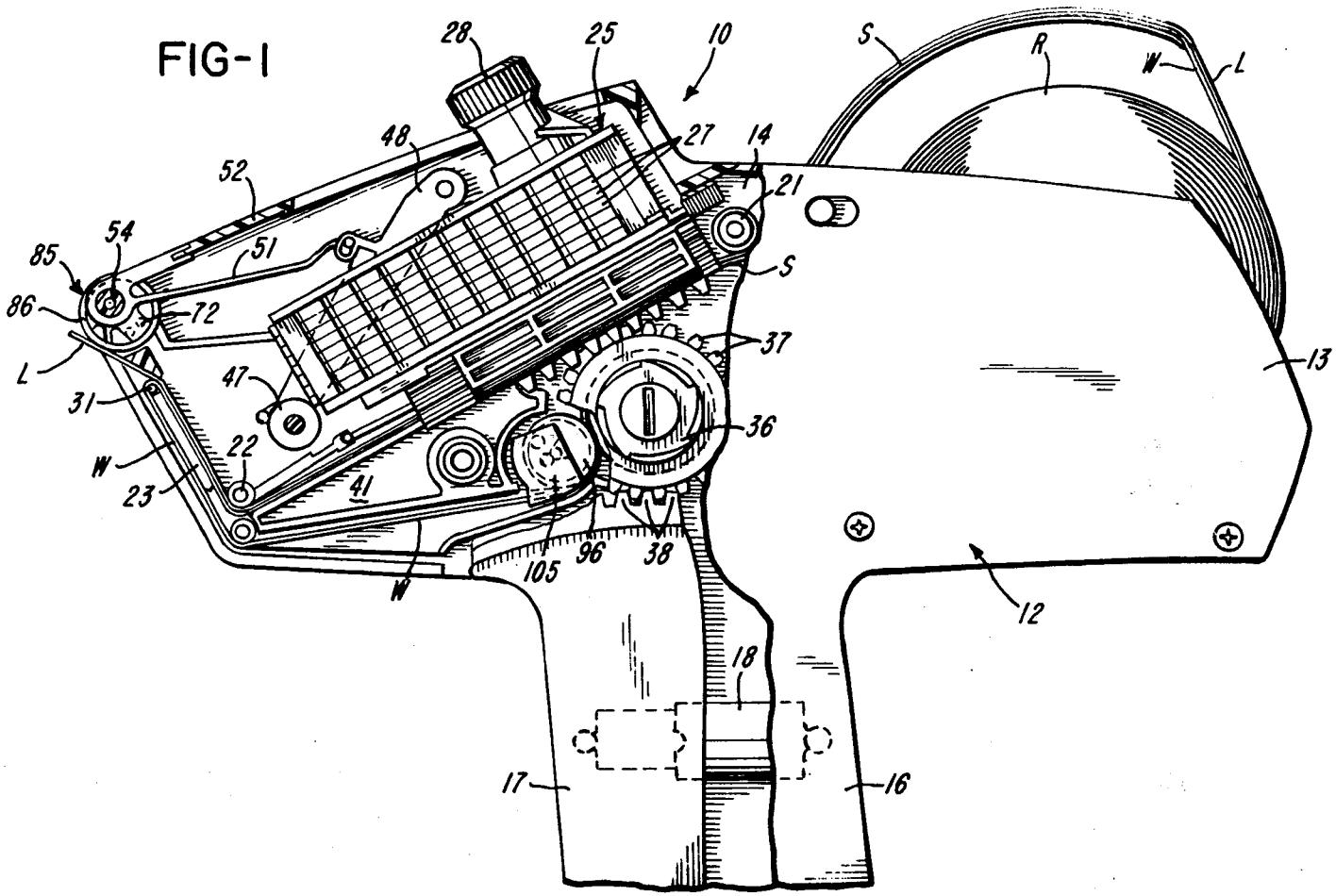
FIG. 1 is side elevational view of a hand-held label printing and applying apparatus or labeler constructed in accordance with the invention and with portions broken away to show internal construction.

A hand-held labeler 10 (FIG. 1) includes a housing 12 formed by two mating side sections 13 and 14 which are preferably molded of a plastics material. The housing includes a handle portion 16 having a finger operated trigger actuator 17 biased outwardly by a spring unit 18. The specific construction of the housing 12 and the components enclosed therein are described in above-mentioned U.S. Pat. No. 4,280,863 and also in U.S. Pat. Nos. 4,100,852 and No. 4,116,747 which also issued to the assignee of the present invention. The label printing and applying apparatus or labeler is adapted to receive a supply of pressure sensitive labels L which are carried by a web W wound into a roll R supported for rotation between the housing sections 13 and 14.

The strip S of the carrier web and attached labels is directed forwardly with the labeler by a set of rollers 21 and 22 and then upwardly across the inner surface of a flat platen 23 where the labels are successively printed by the reciprocating movement of a print head 25. The print head is illustrated in the form of a single line printing head, but may also be in the form of a dual line printing head. Each line of printing is selected by individually positioning a set of movable endless flexible printing bands 27 through adjustment of a corresponding band setting unit 28.

As disclosed in the above-mentioned patents, after each pressure sensitive label L is printed on the platen 23 by movement of the print head 25 in response to the retraction of the trigger actuator 17, the label strip S is advanced by a predetermined increment when the actuator 17 is released. The printed label is peeled from the carrier web at a delaminator roller 31 where the carrier web W reverses and is directed downwardly and rearwardly through the labeler to a feed wheel 34. The feed wheel is indexed through a ratchet wheel 36 connected to a gear 37 which engages teeth 38 on the actuator 17. The details of the mechanism for moving the print head 25 and indexing the feed wheel 34 in response to movement of trigger actuator 17 are described in above-mentioned U.S. Pat. Nos. 4,100,852 and No. 4,116,747.

Figure 2:
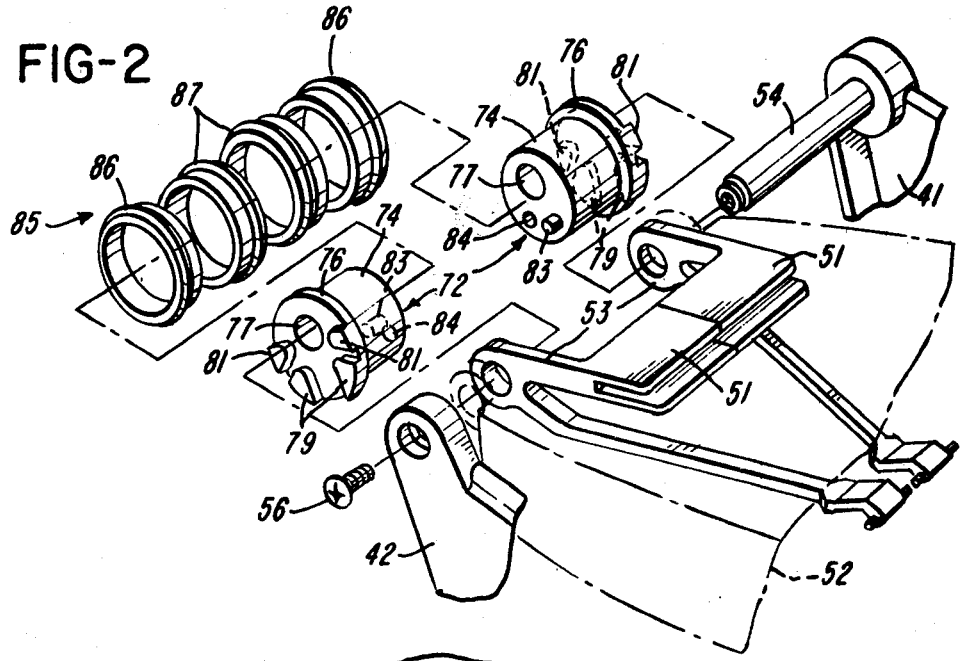
FIG. 2 is an exploded perspective view of the applicator assembly used in the labeler shown in FIG. 1.
Figure 3:
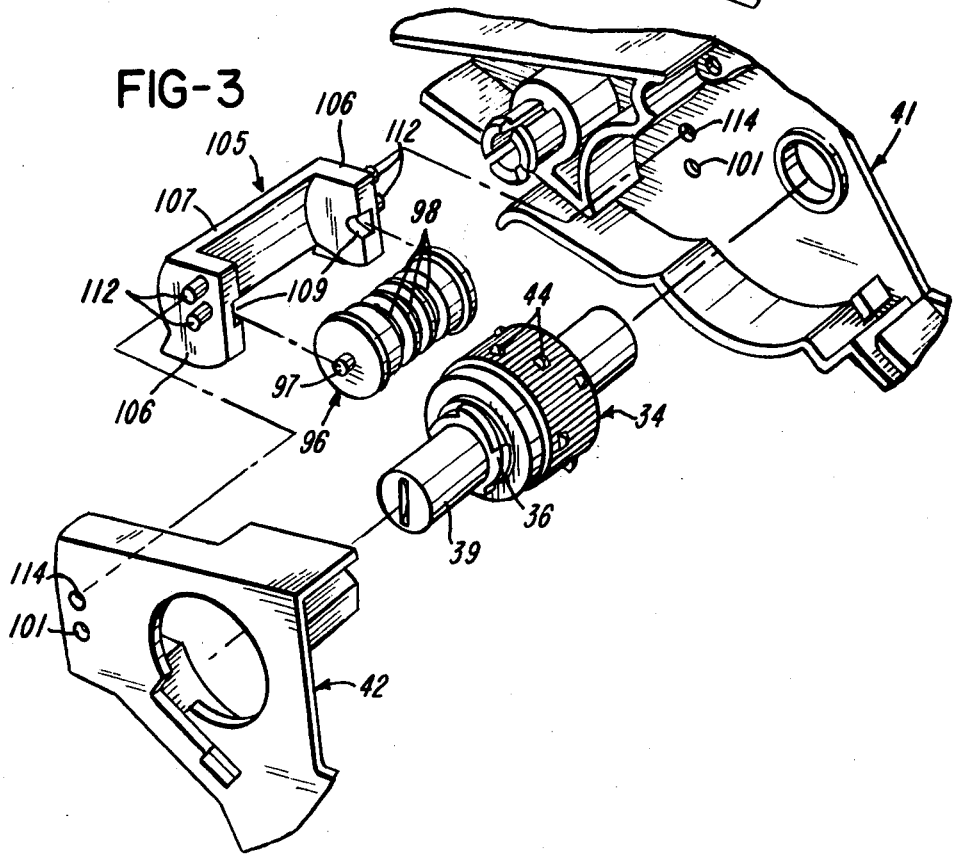
FIG. 3 is an exploded perspective view of the feed wheel and form roller assembly used on the labeler shown in FIG. 1.

As shown in FIG. 3 the feed wheel 34 is supported by a shaft 39 and is confined within an internal sub-frame including a pair of mating side sections 41 and 42 which are supported between the side sections 13 and 14 of the housing. The feed wheel 34 has peripherally spaced teeth 44 (FIG. 3) for engaging or entering corresponding holes (not shown) within the carrier web W as the web is directed around the feed wheel 34. As also disclosed in the above-mentioned patents, when the print head 25 is driven towards the platten 23, the aligned printing characters on the print bands 27 receive a coating of ink from an ink roller 47 which is supported by a pair of pivot arms 48 normally biased to the position shown in FIG. 1 by a pair of molded plastic spring elements 51. The print head 25 is covered by a molded plastic cover section 52 which receives portions 53 of the elements 51 and is pivotally supported by a cross shaft 54 molded as an integral part of the housing section 14. The shaft 54 also extends through the portions 53 of the spring elements 51 and is secured to the other housing section 13 by a screw 56 (FIG. 2).

As best shown in the above-mentioned U.S. Pat. No. 4,280,863, the shaft 54 is adapted to support a multiple roller applicator 60 (FIG. 4) which rotates on the axis of the shaft 54. The applicator 60 is adapted to receive and apply relatively long labels L' (FIG. 4) after each label is stripped from the carrier web and while the trailing edge of the label remains attached to the carrier web. A set of reference planes 62 and 63 (FIG. 4) tangent to the applicator 60 form a desired label applicating angle 64 for the longer labels L'. However, if the applicator 60 was used to apply the shorter labels L, the effective applicating angle 67 formed between the tangent reference planes 63 and 68 is not sufficient to assure that the leading edge portion of each label L will be attached to the surface of the article which is to receive the label.

In accordance with the present invention, a set of adaptors or hubs 72 (FIG. 2) are mounted on the shaft 54 between the portions of the spring elements 51, and each adaptor or hub 72 includes a cylindrical portion 74 projecting axially from an enlarged head portion 76. The hubs 72 have aligned holes 77 which are eccentric or parallel spaced to the center axis of the hubs 72 and receive the shaft 54. Preferably, the hubs 72 are identical, and the head portion 76 of each hub is provided with a set of protrusions 79 and 81 for receiving the portion 52 of the adjacent spring element 51 to prevent rotation of the hub 72 on the non-rotating shaft 54. The cylindrical portions 74 of hubs 72 have interfitting pins 83 and holes 84 and support a label applicator 85 in the form of molded plastic annular rollers 86 and 87 each being freely rotatable on the cylindrical portions 74.

Figure 4:
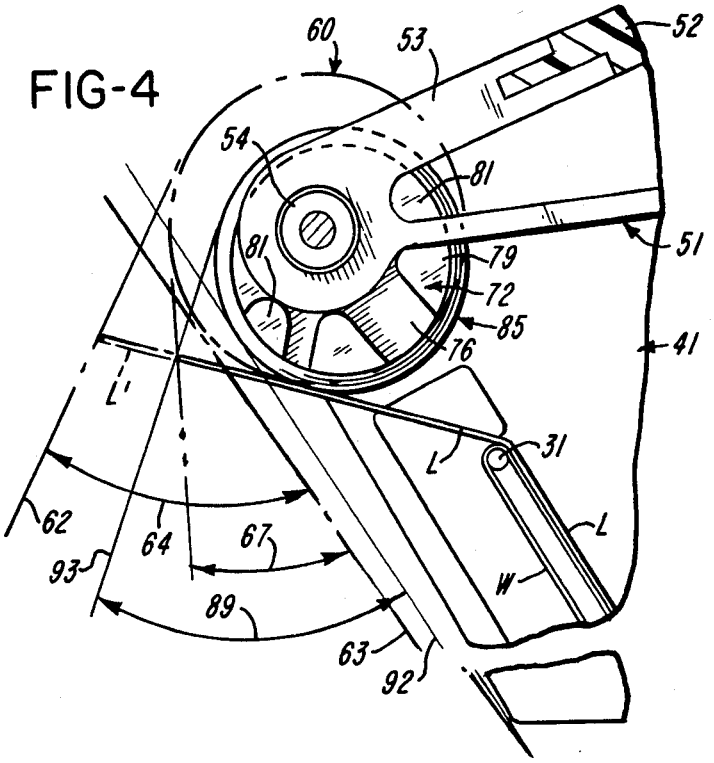
FIG. 4 is an enlarged fragmentary section and end view of the assembled applicator and delaminator shown in FIGS. 1 and 2.

As apparent from FIG. 4, the applicator rollers 86 and 87 are smaller in diameter than the rollers of the applicator 60 and rotate on the axis of the adaptors or hubs 72 eccentric to the axis of the shaft 54. As also illustrated in FIG. 4, when the applicator 85 is used to apply relatively short labels L, the label application angle 89 between the tangent reference planes 92 and 93 is substantially the same as the label application angle 64 for the applicator 60. As a result, the labeler 10 may be used for applying the shorter labels L simply by replacing the applicator 60 with the applicator 85 and the hubs 72.

Figure 5:
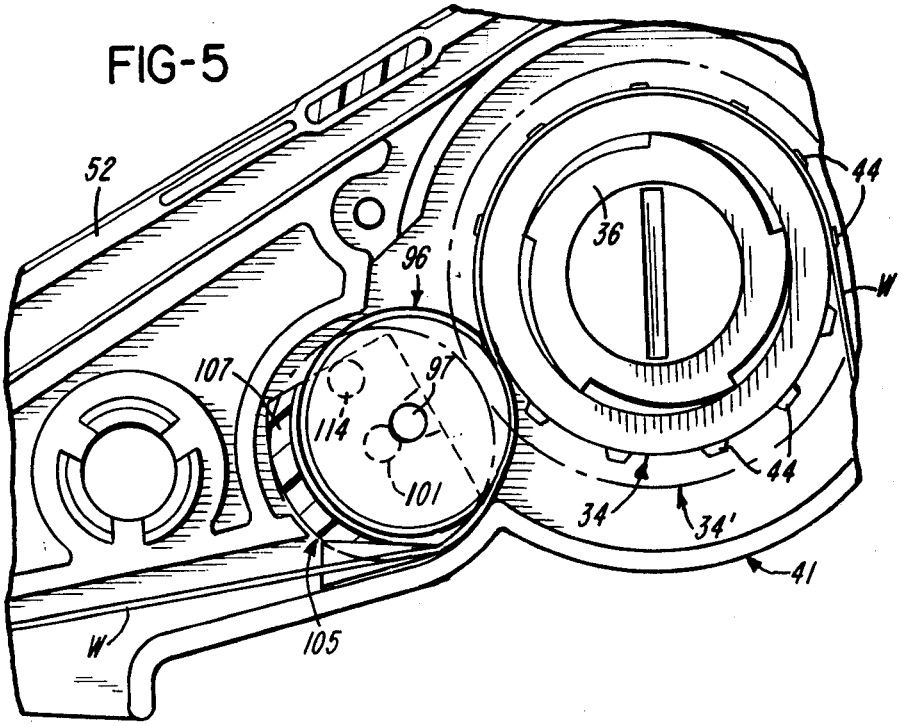
FIG. 5 is an enlarged fragmentary section and end view of the assembled feed wheel and form roller shown in FIGS. 1 and 3.

Referring to FIGS. 3 and 5, when the labeler 10 is assembled to print and apply the shorter labels L, a slightly smaller diameter feed wheel 34 is used in place of a larger feed wheel 34' which is used with longer labels L'. The pitch or circumferentially spacing of the teeth 44 on the feed wheel 34 is slightly less than the corresponding pitch of the teeth on the feed wheel 34' and correspond with the closer longitudinal spacing of the feed holes within the carrier web W.

As shown in FIG. 5, the carrier web W is directed into engagement or contact with the feed wheel 34 by a form roller 96 which has outwardly projecting end journals 97 and axially spaced grooves 98 for receiving the teeth 44 on the feed wheel 34. When the form roller 96 is used in combination with the larger diameter feed wheel 34', the end journals 97 are supported within holes 101 (FIG. 3) formed within the sub-frame side sections 41 and 42. When the form roller 96 is used with the smaller diameter feed wheel 34 for shorter labels, the form roller 96 is supported by a U-shaped adaptor 105 (FIG. 3). Preferably, the adaptor 105 is molded of a rigid plastics material and includes parallel spaced end walls 106 integrally connected by a laterally extending wall 107.

Recesses 109 are formed within the end walls 106 and receive the end journals 97 of the form roller 96 so that the axis of rotation of the form roller 96 is closer to the axis of rotation of the feed wheel 34, as shown in FIG. 5. A pair of studs or pins 112 project outwardly from each end wall 106, and the lower set of pins 112 are received within the holes 101. The upper set of pins 112 are received in another set of aligned holes 114 which are also formed within the sub-frame side sections 41 and 42. The pins 112 prevent the adaptor 105 from rotating so that the adaptor 105 positions the form roller 96 for rotation adjacent the feed wheel 34.

From the drawings and the above description, it is apparent that a hand-held label printing and applying apparatus or labeler constructed in accordance with the present invention, provides desirable features and advantages. As a primary advantage, the labeler 10 may be assembled with the applicator 60 and the feed wheel 34' so that the labeler may be used for printing and applying the longer labels L'. The labeler 10 may also be assembled with the applicator 85, feed wheel 34 and adaptors 72 and 105 so that the labeler may be used for printing and applying the shorter labels L.

If the labeler is assembled to print and apply the shorter labels L, the effective angle 89 of label application is substantially the same as the effective angle 64 of label application provided when the labeler is assembled to print and apply the longer labels L'. This effective angle of label application is important to insure that each label is properly pressed or applied to the surface of the article receiving the label in response to the normal angle of movement of the hand-held labeler during the label applying step. As another advantage, the adaptors 74 and 105 may be conveniently and quickly assembled during the assembly of the labeler 10 and are relatively inexpensive molded plastic parts so that the manufacturing costs of the labeler 10 for printing and applying shorter labels L is not significantly greater than the manufacturing cost for a labeler which prints and applies longer labels L'.

While the form of labeler herein described constitutes a preferred embodiment of the invention, it is to be understood that the invention is not limited to this precise form of labeler, and that changes may be made therein without departing from the scope and spirit of the invention as defined in the appended claims.

The invention having thus been described, the following is claimed:

1. Apparatus for successively printing and applying a series of pressure sensitive labels carried by a web of supporting material, the apparatus comprising a platen, printing means cooperable with the platen for successively printing the labels, delaminating means disposed for separating each label from the web after the label is printed, means for feeding the web to present each label to the platen and printing means and then past the delaminating means, a roller for directing the labels or the carrier web, an adaptor supporting the roller for rotation on a first axis when the apparatus is assembled for printing relatively short labels, means for supporting the adaptor, and the adaptor supporting means being effective to support the roller or another roller for rotation on a second axis spaced parallel to the first axis when the apparatus is assembled without the adaptor printing longer labels.

2. Apparatus as defined in claim 1 wherein the roller comprises an annular label applicator roller, the adaptor supporting means comprise a non-rotating shaft extending through the label applicator roller, and the adaptor comprises a generally cylindrical hub member having an axially extending eccentric hole receiving the shaft.

3. Apparatus as defined in claim 2 and including a set of the hub members mounted on the shaft, and a series of the applicator rollers are supported for rotation by the hub members.

4. Apparatus as defined in claim 3 wherein the hub members are substantially identical with each hub member including an enlarged head portion, and the hub members are arranged on the shaft in opposing relation.

5. Apparatus as defined in claim 2 wherein the hub member includes a cylindrical portion projecting from an enlarged head portion, and the head portion includes means for locking the hub member against rotation.

6. Apparatus as defined in claim 1 wherein the roller comprises a form roller, the feeding means comprise a feed wheel having outwardly projecting peripherially spaced teeth and supported for rotary indexing movement, and the adaptor supports the form roller adjacent the feed wheel for rotation on the first axis.

7. Apparatus as defined in claim 6 wherein the adaptor is U-shaped and includes parallel spaced end walls integrally connected by a laterally extending wall, the form roller having end journals projecting outwardly into recesses formed within the end walls, and the end walls having support studs projecting outwardly on the first axis.

8. Apparatus for successively printing and applying a series of pressure sensitive labels carried by a web of supporting material, the apparatus comprising a platen, printing means cooperable with the platen for successively printing the labels, delaminating means disposed for separating each label from the web after the label is printed, an annual label applicator roller disposed for applying each separated printed label to an article, means for incrementally advancing the web to present each label to the platen and printing means and then past the delaminating means, means supporting the label applicating roller for rotation and including a non-rotating shaft having a first axis, at least one generally cylindrical adaptor member having an axially extending eccentric hole receiving the shaft, the adaptor member supporting the applicator roller for rotation on a second axis spaced parallel to the first axis, and means for securing the adaptor member against rotation.

9. Apparatus as defined in claim 8 and including a pair of the adaptor members each having an enlarged head portion, and the adaptor members are mounted on the shaft in opposing relation.

10. Apparatus as defined in claim 9 wherein the head portion of each adaptor member includes a portion of the means for securing the adaptor member against rotation.

11. Apparatus for successively printing and applying a series of pressure sensitive labels carried by a web of supporting material, the apparatus comprising a platen, printing means cooperable with the platen for successively printing the labels, delaminating means disposed for separating each label from the web after the label is printed, means including a feed wheel for pulling the web to present each label to the platen and printing means and then past the delaminating means, a form roller positioned for directing the carrier web into engagement with the feed wheel, an adaptor having means for supporting the form roller for rotation on a first axis, means for supporting the adaptor, and the adaptor supporting means being effective to support the form roller for rotation on a second axis spaced parallel to the first axis when the apparatus is assembled without the adaptor.

12. Apparatus as defined in claim 11 wherein the adaptor is U-shaped and includes parallel spaced end walls integrally connected by a laterally extending wall, the form roller having end journals projecting outwardly on the first axis into recesses formed within the end walls, and the end walls having support studs projecting outwardly on the second axis.

13. Apparatus for successively printing and applying a series of pressure sensitive labels carried by a web of supporting material, the apparatus comprising a platen, printing means cooperable with the platen for successively printing the labels, delaminating means disposed for separating each label from the web after the label is printed, means including a feed wheel and an adjacent form roller for advancing the web to present each label to the platen and printing means and then past the delaminating means, an applicator roller for applying each separated label to a corresponding article, and means for selectively supporting each of the form and applicator rollers for rotation on first and second parallel spaced axes for accommodating labels of different lengths.

14. Apparatus as defined in claim 13 wherein the supporting means comprise a generally cylindrical adaptor hub having an eccentric hole and supporting the applicator roller for rotation thereon.

15. Apparatus as defined in claim 13 wherein the supporting means comprise a generally U-shaped adaptor having means supporting opposite ends of the form roller for rotation.

* * * * *